US005829324A

United States Patent [19]

Secor

[11] Patent Number: 5,829,324

[45] Date of Patent: Nov. 3, 1998

[54] EXTRACTOR FOR DAMAGED LIGHT BULPS

[76] Inventor: Harold E. Secor, 1449 Larchmont Dr., Plano, Tex. 75074

[21] Appl. No.: 808,796

[22] Filed: Feb. 28, 1997

[51] Int. Cl.[6] ..... H01K 3/32

[52] U.S. Cl. ..... 81/53.11; 81/436; 81/461

[58] Field of Search ..... 81/53.11, 53.12, 81/436, 441, 439, 461, 64, 451, 452

[56] References Cited

U.S. PATENT DOCUMENTS

| | | | |
|---|---|---|---|
| 556,959 | 3/1896 | Butterfield | 81/53.11 |
| 1,831,477 | 11/1931 | Birong et al. | 81/53.11 |
| 2,516,650 | 7/1950 | Shapiro et al. | 81/53.11 |
| 3,101,212 | 8/1963 | Cater | 81/53.11 |
| 4,478,115 | 10/1984 | Ellis | 81/436 |
| 5,148,723 | 9/1992 | Newman, Sr. et al. | 81/53.11 |
| 5,231,733 | 8/1993 | Dittman | 81/53.11 |
| 5,386,748 | 2/1995 | Kilgore | 81/121.1 |
| 5,490,438 | 2/1996 | Zupo et al. | 81/53.11 |

*Primary Examiner*—James G. Smith
*Assistant Examiner*—Lee Wilson

[57] ABSTRACT

A new Extractor for Damaged Light Bulbs for removing the base of a broken light bulb from a socket easily and safely. The inventive device includes a four tiered flexible plastic tool a threaded part and a handle.

17 Claims, 3 Drawing Sheets

EXTRACTOR FOR DAMAGED LIGHT BULPS

BACKGROUND OF THE INVENTION

1. Field of the Invention

The present invention relates to tools for extracting broken bulbs and more particularly pertains to a new Extractor for Damaged Light Bulbs for removing the base of a broken light bulb from a socket easily and safely.

2. Description of the Prior Art

The use of tools for extracting broken bulbs is known in the prior art. More specifically tools for extracting broken bulbs heretofore devised and utilized are known to consist basically of familiar, expected and obvious structural configurations, notwithstanding the myriad of designs encompassed by the crowded prior art which have been developed for the fulfillment of countless objectives and requirements.

Known prior art tools for extracting broken bulbs include U.S. Pat. No. 5,103,695; U.S. Pat. No. 4,485,701; U.S. Pat. No. 297,499; U.S. Pat. No. 4,314,723; U.S. Pat. No. 5,317,939 and U.S. Pat. No. 5,031,487.

While these devices fulfill their respective, particular objectives and requirements, the aforementioned patents do not disclose a new Extractor for Damaged Light Bulbs. The inventive device includes a four tiered flexible plastic tool, threaded means, and a handle.

In these respects, the Extractor for Damaged Light Bulbs according to the present invention substantially departs from the conventional concepts and designs of the prior art, and in so doing provides an apparatus primarily developed for the purpose of removing the base of a broken light bulb from a socket easily and safely.

SUMMARY OF THE INVENTION

In view of the foregoing disadvantages inherent in the known types of tools for extracting broken bulbs now present in the prior art, the present invention provides a new Extractor for Damaged Light Bulbs construction wherein the same can be utilized for removing the base of a broken light bulb from a socket easily and safely.

The general purpose of the present invention, which will be described subsequently in greater detail, is to provide a new Extractor for Damaged Light Bulbs apparatus and method which has many of the advantages of the tools for extracting broken bulbs mentioned heretofore and many novel features that result in a new Extractor for Damaged Light Bulbs which is not anticipated, rendered obvious, suggested, or even implied by any of the prior art tools for extracting broken bulbs, either alone or in any combination thereof.

To attain this, the present invention generally comprises a four tiered flexible plastic tool, threaded means, and a handle.

There has thus been outlined rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Extractor for Damaged Light Bulbs apparatus and method which has many of the advantages of the tools for extracting broken bulbs mentioned heretofore and many novel features that result in a new Extractor for Damaged Light Bulbs which is not anticipated, rendered obvious, suggested, or even implied by any of the prior art tools for extracting broken bulbs, either alone or in any combination thereof.

It is another object of the present invention to provide a new Extractor for Damaged Light Bulbs which may be easily and efficiently manufactured and marketed.

It is a further object of the present invention to provide a new Extractor for Damaged Light Bulbs which is of a durable and reliable construction.

An even further object of the present invention is to provide a new Extractor for Damaged Light Bulbs which is susceptible of a low cost of manufacture with regard to both materials and labor, and which accordingly is then susceptible of low prices of sale to the consuming public, thereby making such Extractor for Damaged Light Bulbs economically available to the buying public.

Still yet another object of the present invention is to provide a new Extractor for Damaged Light Bulbs which provides in the apparatuses and methods of the prior art some of the advantages thereof, while simultaneously overcoming some of the disadvantages normally associated therewith.

Still another object of the present invention is to provide a new Extractor for Damaged Light Bulbs for removing the base of a broken light bulb from a socket easily and safely.

Yet another object of the present invention is to provide a new Extractor for Damaged Light Bulbs which includes an extractor tool having a stepped bulb base engaging portion for extracting one or more sizes of light bulb bases.

Still yet another object of the present invention is to provide a new Extractor for Damaged Light Bulbs that is capable of removing more than one size of light bulb base without having to employ a different tool.

Even still another object of the present invention is to provide a new Extractor for Damaged Light Bulbs that is designed to remove light bulb bases from sockets with a extension handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
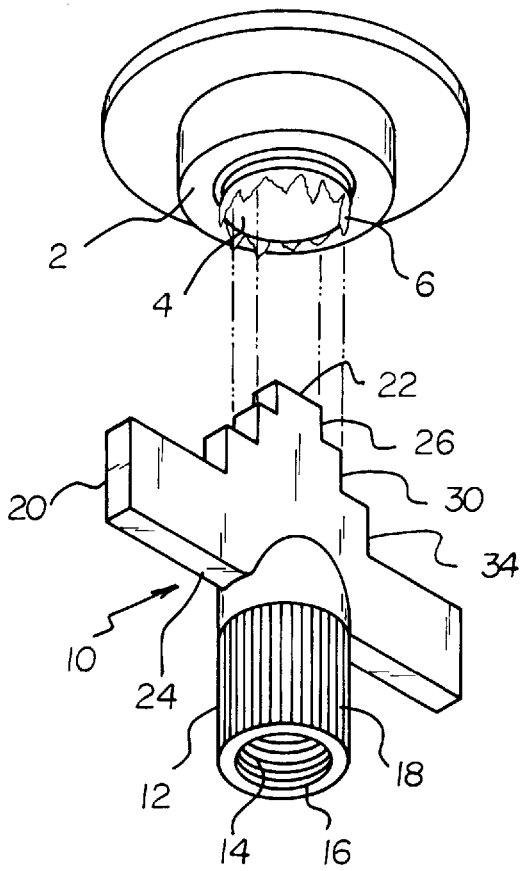
FIG. 1 is a perspective view of a new Extractor for Damaged Light Bulbs according to the present invention particularly illustrating the manner of insertion of the extractor tool in a damaged bulb base.

With reference now to the drawings, and in particular to FIGS. 1 through 6 thereof, a new Extractor for Damaged Light Bulbs embodying the principles and concepts of the present invention and generally designated by the reference numeral 10 will be described.

More specifically it will be noted that the Extractor for Damaged Light Bulbs 10 comprises a extractor tool having a light bulb base engaging portion and a handle portion.

As best illustrated in FIGS. 1 through 6, it can be shown that the present invention teaches a novel and nonobvious tool for removing the base of a damaged light bulb from a light bulb socket when the glass bulb part of the light bulb is no longer intact and available for gripping and turning by hand.

The present invention includes generally an, extractor apparatus 10 for removing from a light socket 2 the threaded base 14 of a light bulb having the glass enclosure 6 substantially broken away from the threaded base 14. The extractor apparatus or tool 10 comprising a light bulb base 4 engaging portion 20, a handle portion 12, and a concave-shaped cup 40. The base engaging portion 20 is adapted to be at least partially inserted into the base of a damaged light bulb 4 and engage the interior of the base 4 in a manner such that the base of the light bulb 4 may be rotatingly removed from a light bulb socket by rotating the extractor tool 10.

Figure 2:
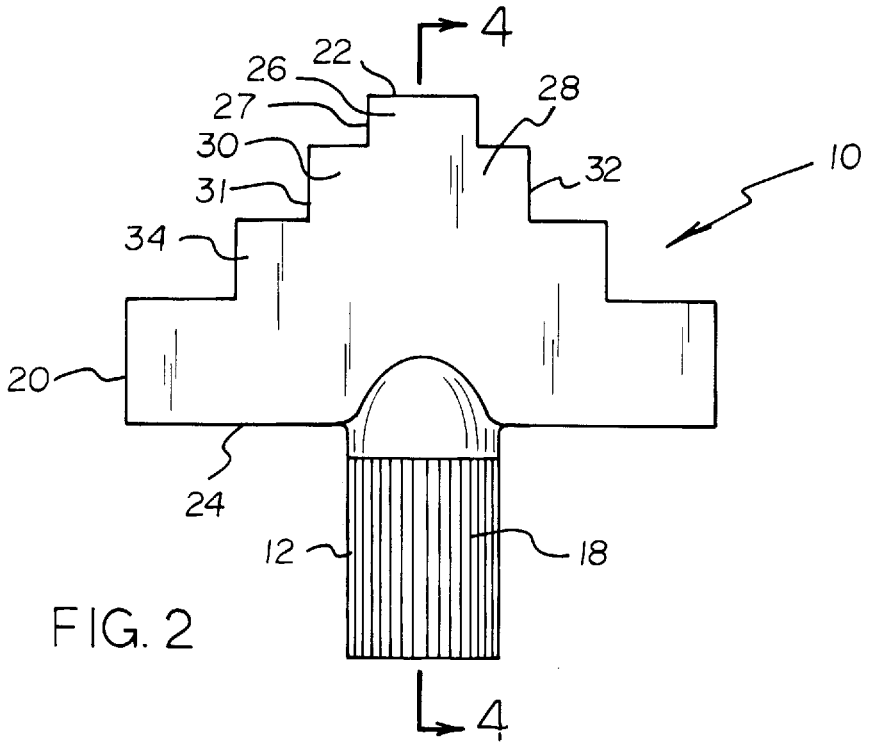
FIG. 2 is a side elevation view thereof.
Figure 3:
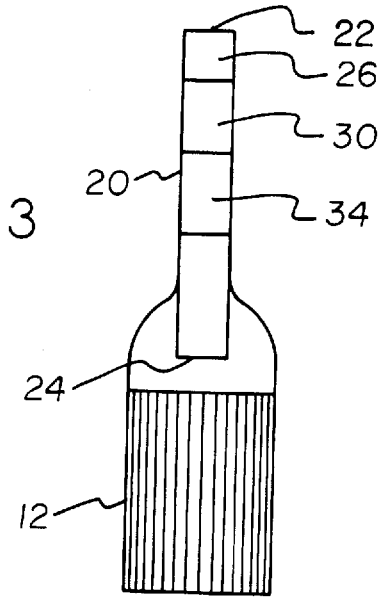
FIG. 3 is a side view of the present invention.
Figure 4:
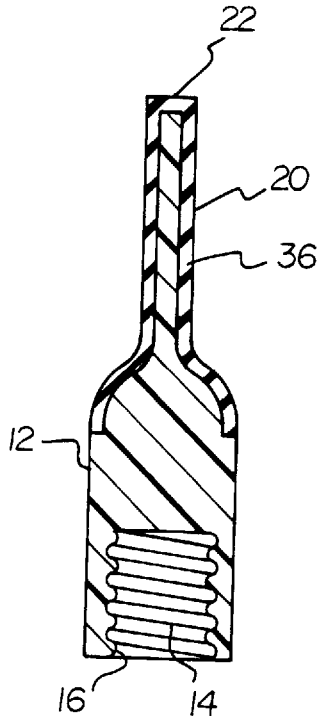
FIG. 4 is a cross sectional view taken along line 4—4 of FIG. 2.
Figure 5:
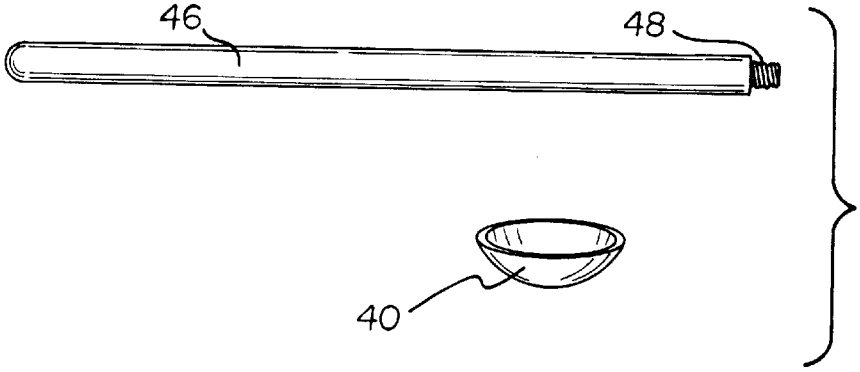
FIG. 5 is a side elevation of an optional extension handle and an optional safety cup of the present invention.
Figure 6:
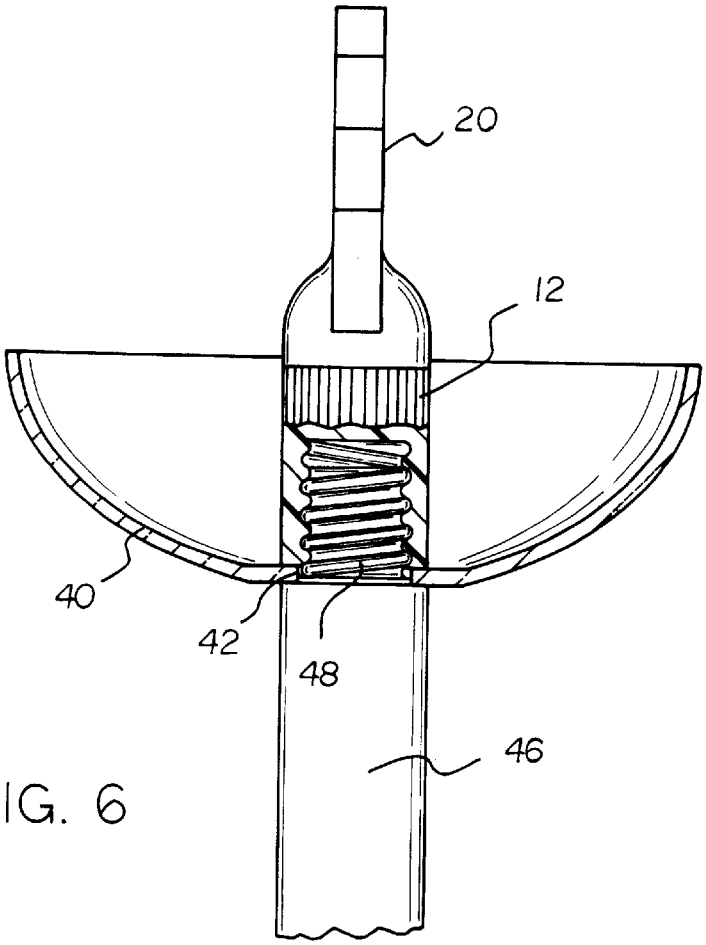
FIG. 6 is a cross sectional view of the present invention with the optional extension handle and optional safety cup feature installed thereon.

The base engaging portion 20 comprises a stepped plate member having at least two tiers (e.g., a first tier 26, a second tier 30 and a third tier 34) shown in FIGS. 1 & 2. Each tier has a pair of opposite engaging edges, with the first tier 26 having opposite edges 27, 28 and the second tier 30 having opposite edges 31, 32. Each pair of opposite edges define a width therebetween with, the width of each tier 26,30 and 34 being different from the width of the other tiers. The width of each tier is adapted to permit the tier to be inserted into the base of a light bulb 4 so that the opposite engaging edges of the tier to engage and press against substantially opposite surfaces in the interior of the light bulb base 4. The various widths of the tiers of the extractor tool 10 permit the tool to fit more than one size of bulb base. The width of the first tier 26 is adapted to fit the base of a candelabra-type bulb. The width of the second tier 30 is adapted to fit the base of a standard light bulb. The width of the third tier 34 can be adapted to fit larger size bulbs.

The base engaging portion 20 of the extractor tool 10 has opposite engaging edges 27, 28, 31 & 32 comprised of a deformable material layer 36 to thereby permit deformation of the engaging edges against opposite surfaces in the interior of a light bulb base 4. The handle portion 12 includes a threaded cavity 14 therein for removably receiving the threaded end 48 of an extension handle 46 shaft. The threaded cavity 14 has an opening 16 with a diameter of between about ½ to ¾ inch. The handle portion 12 may have a plurality of axial ribs 18 to permit easy threading and unthreading of the extension handle from the handle portion. A concave-shaped cup 40 is removably mounted between the handle portion 12 of the extractor tool 10 and an extension handle 46, with the threaded end 48 of the handle 46 passing through a hole 42 in the cup 40. The cup 40 is thereby positioned below the engaging portion 20 during an overhead bulb base removing operation to permit the cup 40 to catch any debris falling from a bulb base 4 engaged by the bulb base engaging portion 20. The base engaging portion 20 has a tip 22 and a mounting edge 24.

As to a further discussion of the manner of usage and operation of the present invention, the same should be apparent from the above description. Accordingly, no further discussion relating to the manner of usage and operation will he provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extractor apparatus for removing from a light socket a threaded base of a light bulb having a glass enclosure of the light bulb substantially broken away from the threaded base, said threaded bulb base having an interior circumferential surface, said extractor apparatus comprising:

an extractor tool having a light bulb base engaging portion and a handle portion, said handle portion includes a threaded cavity therein for removably receiving the threaded end of an extension handle shaft;

said base engaging portion being adapted to be at least partially inserted in the threaded bulb base of a damaged light bulb and engage the interior of said threaded bulb base in a manner such that the threaded bulb base may be rotatingly removed from a light bulb socket by rotating the extractor tool;

said base engaging portion comprising:

a substantially flat member having a stepped perimeter defining at least one tier of opposite and substantially parallel engaging edges;

each said tier of engaging edges defining a width therebetween;

said width being adapted to permit the engaging edges of said tier to engage and press against substantially opposite sections of the interior circumferential surface of said threaded bulb base; and wherein said extractor tool has a central longitudinal axis with each of the opposite engaging edges of each said tier being located substantially equidistant from said central longitudinal axis such that the engaging edges of each of said tiers are symmetrical about said longitudinal axis;

wherein said extractor tool has a tip located on said base engaging portion opposite the mounting of said handle portion on said base engaging portion; and said base engaging portion having:

at least two tiers of opposite engaging edges, the width of each of said tiers being different from the other said tiers; and said tip having a tier with a relatively smaller width than the width of a tier located further away from said tip such that said base engaging portion becomes wider away from said tip toward said handle portion.

2. The extractor apparatus of claim 1 wherein the width between the engaging edges of a said tier is adapted to permit the opposite engaging edges to engage substantially opposite sections of the interior circumferential surface of a candelabra-type bulb.

3. The extractor apparatus of claim 1 wherein the width between the engaging edges of a said tier is adapted to permit the opposite engaging edges to engage substantially opposite sections of the interior circumferential surface of a standard light bulb.

4. The extractor apparatus of claim 1 wherein the longitudinal length of the engaging edges of each tier is about ¼ inch.

5. The extractor apparatus of claim 1 wherein said base engaging portion comprises a plate member with substantially parallel opposite surfaces oriented substantially perpendicular to the engaging edges of said base engaging portion.

6. The extractor apparatus of claim 1 wherein said handle portion further includes a plurality of axial ribs on an outer surface.

7. The extractor apparatus of claim 6 wherein the threaded cavity has an opening with a diameter of between about ½ to ¾ inch.

8. The extractor apparatus of claim 1 wherein the bulb base portion of said extractor tool includes a deformable covering on the exterior surface of the opposite engaging edges of each tier of said bulb base engaging portion.

9. The extractor apparatus of claim 8 wherein the deformable covering is adhesively affixed to the exterior surface of said bulb base engaging portion.

10. The extractor apparatus of claim 1 further comprising a concave-shaped cup mounted to said extractor tool for catching any debris falling from a bulb base engaged by said bulb base engaging portion.

11. The extractor apparatus of claim 10, wherein the concave-shaped cup comprises a plastic.

12. The extractor apparatus of claim 10 wherein the concave-shaped cup is removably mounted to the handle portion of the extractor tool.

13. The extractor apparatus of claim 1 wherein the base engaging portion of said extractor tool has opposite engaging edges comprised of a deformable material to thereby permit deformation of the engaging edges against opposite surfaces in the interior of a light bulb base.

14. The extractor apparatus of claim 1 wherein the light bulb base engaging portion of said extractor tool has a longitudinal axis along which said base engaging portion is advanceable into a base of a damaged light bulb, and wherein the base engaging portion has at least two tiers, each said tier having opposite engaging edges oriented substantially parallel to said longitudinal axis.

15. The extractor apparatus of claim 1 wherein the base engaging portion has at least two tiers, each said tier having opposite engaging edges defining a width therebetween, and wherein the width of the tier nearest the handle portion is larger than the tier farthest away from the handle portion.

16. The extractor apparatus of claim 1 wherein the bulb base engaging portion of said extractor tool comprises a substantially stiff and elastomeric material.

17. An extractor apparatus for removing from a light socket a threaded base of a light bulb having a glass enclosure of the light bulb substantially broken away from the threaded base, said threaded bulb base having an interior circumferential surface, said extractor apparatus comprising:

an extractor tool having a light bulb base engaging portion, a handle portion, and a concave-shaped cup;

said base engaging portion being adapted to be at least partially inserted in the threaded bulb base of a damaged light bulb and engage the interior of said threaded bulb base in a manner such that the threaded bulb base may be rotatingly removed from a light bulb socket by rotating the extractor tool;

said base engaging portion comprising a substantially flat member having a stepped perimeter defining at least one tier of opposite and substantially parallel engaging edges;

each said tier of engaging edges defining a width therebetween;

said width being adapted to permit the engaging edges of said tier to engage and press against substantially opposite sections of the interior circumferential surface of said threaded bulb base;

wherein said extractor tool has a central longitudinal axis with each of the opposite engaging edges of each said tier being located substantially equidistant from said central longitudinal axis such that the engaging edges of each of said tiers are symmetrical about said longitudinal axis;

said extractor tool having a tip located on said base engaging portion opposite the mounting of said handle portion on said base engaging portion;

said base engaging portion having at least two tiers of opposite engaging edges;

said tip having a tier with a relatively smaller width than the width of a tier located further away from said tip such that said base engaging portion becomes wider away from said tip toward said handle portion;

wherein the base engaging portion has at least three tiers, with the width between the engaging edges of one said tier is adapted to permit the opposite engaging edges to engage substantially opposite sections of the interior circumferential surface of a candelabra-type bulb; and wherein the width between the engaging edges of another said tier is adapted to permit the opposite engaging edges to engage substantially opposite sections of the interior circumferential surface of a standard light bulb;

wherein the base engaging portion of said extractor tool has opposite engaging edges comprised of a deformable material to thereby permit deformation of the engaging edges against opposite sections of the interior circumferential surface in the interior of a light bulb base;

wherein said handle portion includes a threaded cavity therein for removably receiving the end of an extension handle shaft, said threaded cavity having an opening with a diameter of between about ½ to ¾ inch;

wherein said handle portion further includes a threaded cavity therein for removably receiving the threaded end of an extension handle shaft and a plurality of axial ribs on an outer surface; and wherein said concave-shaped cup is removably mounted to the handle portion of said extractor tool for positioning below said engaging portion during an overhead bulb base removing operation to permit said cup to catch any debris falling from a bulb base engaged by said bulb base engaging portion.

* * * * *